US008632023B2

(12) United States Patent
Miller et al.

(10) Patent No.: US 8,632,023 B2
(45) Date of Patent: Jan. 21, 2014

(54) PUSH BUTTON MECHANISM FOR SHOWERHEAD CONTROL

(75) Inventors: Michael Miller, Portage, MI (US); James Wu, Taichung (TW); Alex Wu, Taichung (TW); Cewen Yang, Taichung (TW)

(73) Assignee: Masco Corporation of Indiana, Indianapolis, IN (US)

( * ) Notice: Subject to any disclaimer, the term of this patent is extended or adjusted under 35 U.S.C. 154(b) by 92 days.

(21) Appl. No.: 13/154,902

(22) Filed: Jun. 7, 2011

(65) Prior Publication Data

US 2012/0312899 A1 Dec. 13, 2012

(51) Int. Cl.
*B05B 1/30* (2006.01)
*A62C 31/00* (2006.01)

(52) U.S. Cl.
USPC ..... 239/581.1; 239/443; 239/447; 239/448; 239/449

(58) Field of Classification Search
USPC ..... 239/443, 444, 569, 581.2, 582.1, 583, 239/529, 530, 447–449
See application file for complete search history.

(56) References Cited

U.S. PATENT DOCUMENTS

| | | | | |
|---|---|---|---|---|
| 4,131,233 | A | 12/1978 | Koenig | |
| 5,093,943 | A * | 3/1992 | Wei | 4/615 |
| 5,518,181 | A * | 5/1996 | Shames et al. | 239/381 |
| 5,632,446 | A * | 5/1997 | Krochek | 239/381 |
| 5,730,362 | A * | 3/1998 | Cordes | 239/123 |
| 6,126,091 | A | 10/2000 | Heitzman | |
| 7,341,239 | B2 | 3/2008 | Hodel | |
| 7,520,448 | B2 * | 4/2009 | Luettgen et al. | 239/463 |
| 7,762,479 | B2 * | 7/2010 | Li | 239/396 |
| 8,177,147 | B2 * | 5/2012 | Engel | 239/443 |
| 8,292,200 | B2 * | 10/2012 | Macan et al. | 239/463 |
| 8,348,181 | B2 * | 1/2013 | Whitaker et al. | 239/447 |
| 2007/0194148 | A1 * | 8/2007 | Rosko et al. | 239/526 |
| 2010/0237160 | A1 * | 9/2010 | Miller et al. | 239/1 |
| 2011/0024516 | A1 * | 2/2011 | Li et al. | 239/11 |
| 2011/0226876 | A1 * | 9/2011 | Xu | 239/562 |

OTHER PUBLICATIONS

International Search Report dated Aug. 31, 2012.

* cited by examiner

*Primary Examiner* — Dinh Q Nguyen
*Assistant Examiner* — Alexander M Valvis
(74) *Attorney, Agent, or Firm* — Carlson, Gaskey & Olds P.C.

(57) ABSTRACT

A shower head includes a push-button operated rotatable valve having a plurality of positions including; a first position in which the shower head allows water to flow to a first function, a second position radially offset from the first position in which the shower head allows water to flow to a second function, a third position radially offset from the first position and the second position and to the first position, in which the shower head allows water to flow trickle through the shower head.

23 Claims, 10 Drawing Sheets

PUSH BUTTON MECHANISM FOR SHOWERHEAD CONTROL

BACKGROUND OF THE INVENTION

Many hand held shower heads have controls to offer a multiplicity of functions to users such as sprays, massages, mists and the like. Typically a user can change between functions by using nozzles, rings, dials, buttons, or the like to shift between the functions.

SUMMARY OF THE INVENTION

According to an embodiment disclosed herein, a shower head includes a push-button operated rotatable valve having a plurality of positions including; a first position in which the shower head allows water to flow to a first function, a second position radially offset from the first position in which the shower head allows water to flow to a second function, a third position radially offset from the first position and the second position and to the first position, in which the shower head allows water to flow trickle through the shower head.

According to a further embodiment disclosed herein, a shower head includes a housing and a valve. The housing has a first outlet in fluid communication with a first function, a second outlet in fluid communication with a second function, the first and second outlets being radially offset from each other about an axis, and an inlet axially offset from the first and second outlets. The valve is disposed within the housing and has a first seal that engages the first and second outlets, and a second seal that engages the inlet. The first and second seals are axially and radially offset from each other.

These and other features of the present invention can be best understood from the following specification and drawings, the following of which is a brief description.

DETAILED DESCRIPTION OF THE PREFERRED EMBODIMENT

Figure 1:
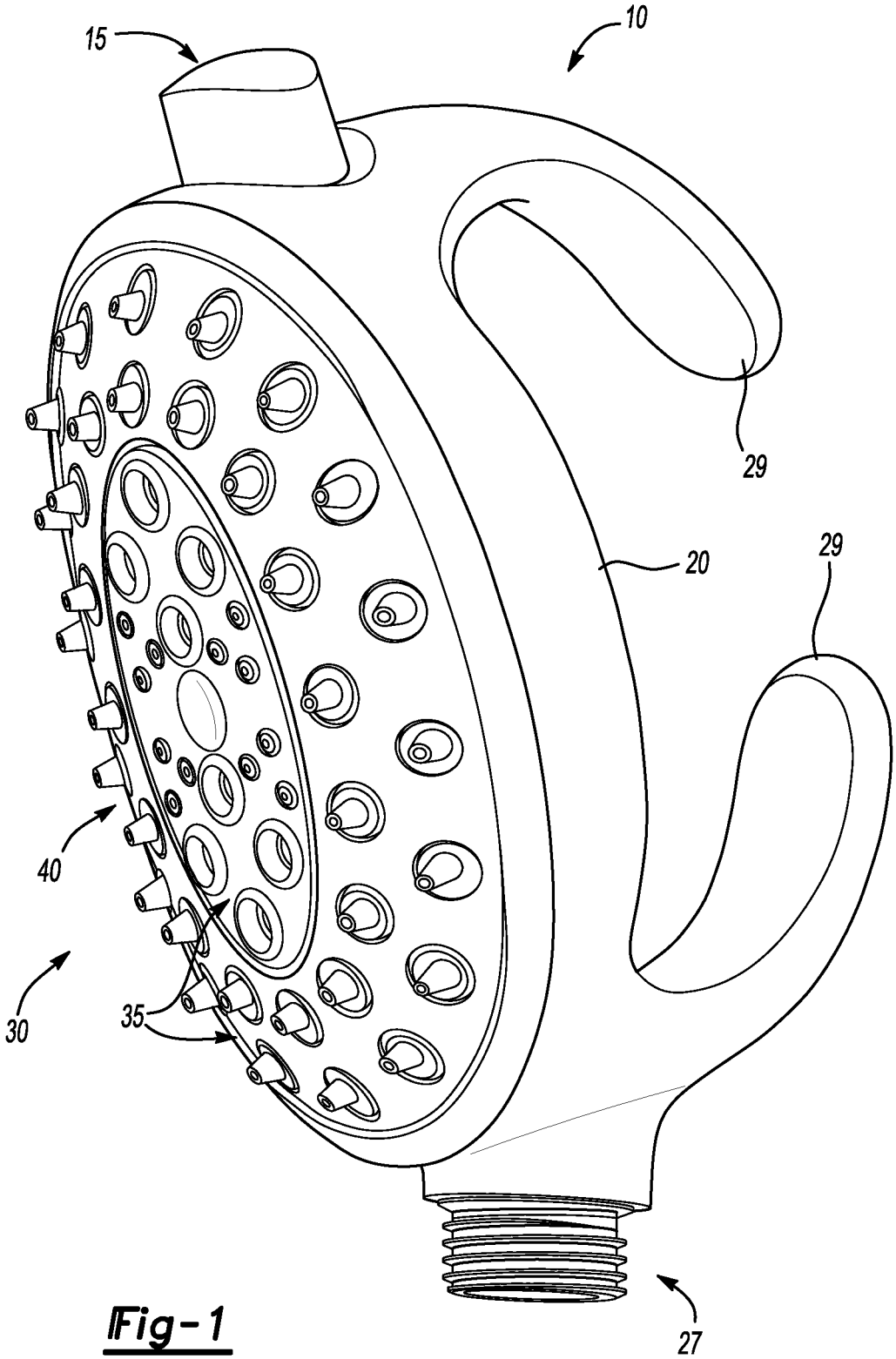
FIG. 1 is a perspective view of a hand held incorporation an embodiment of a selectable shower head.

FIG. 1 shows a perspective view of a hand held head 10. The hand held head 10 has a button 15 for changing the functions delivered by the hand held head 10 which has a housing 20, a pair of hand grips 29, a water inlet 27, a spray face 30 which includes massage nozzles 35 and spray nozzles 40. Typically, the massage nozzles give a rhythmic or harder spray in spray nozzles 40. Water inlet 27 attaches to a hose (not shown) to provide water to the hand held shower 10.

Figure 2:
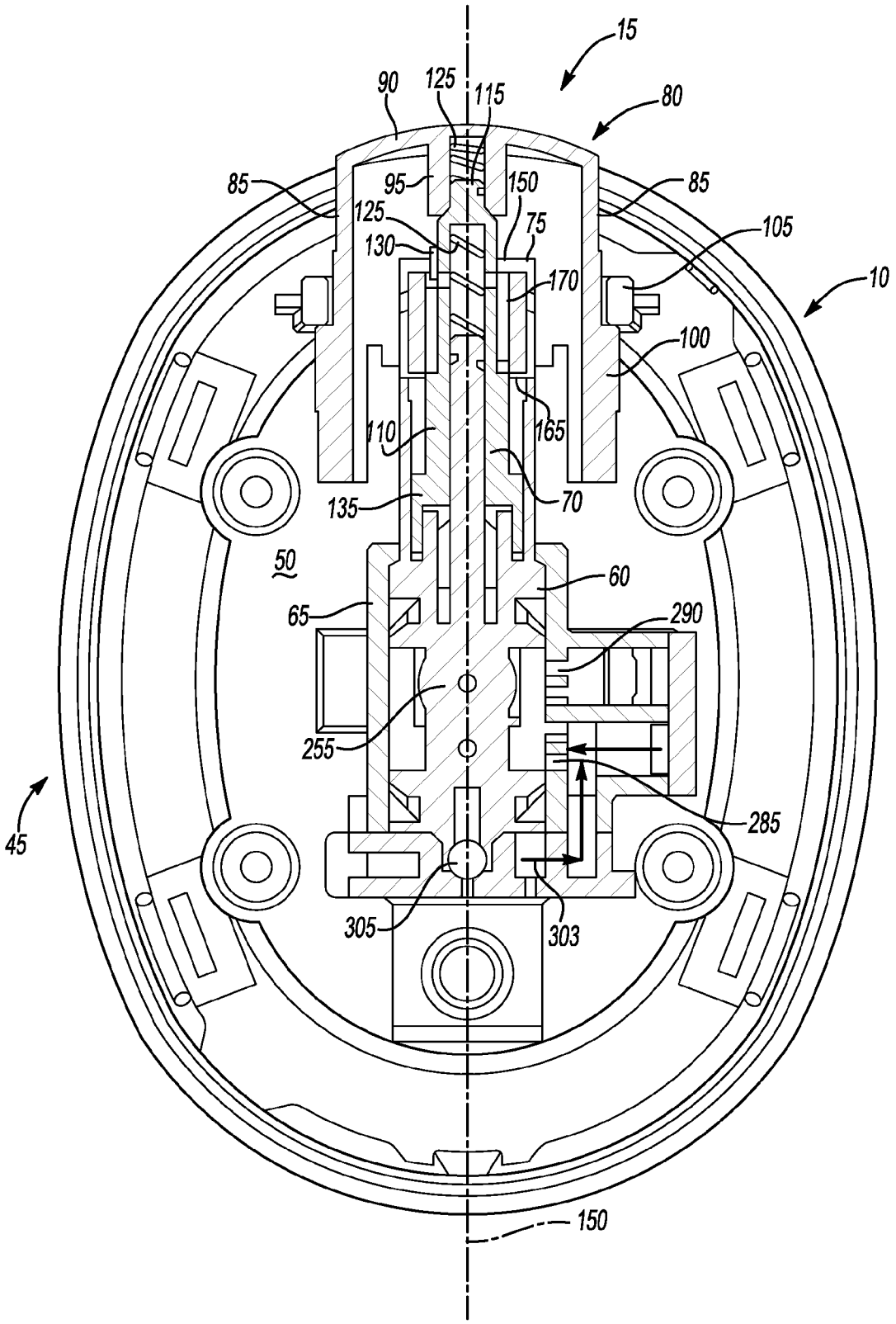
FIG. 2 is a cutaway view of the hand held of FIG. 1.
Figure 7:
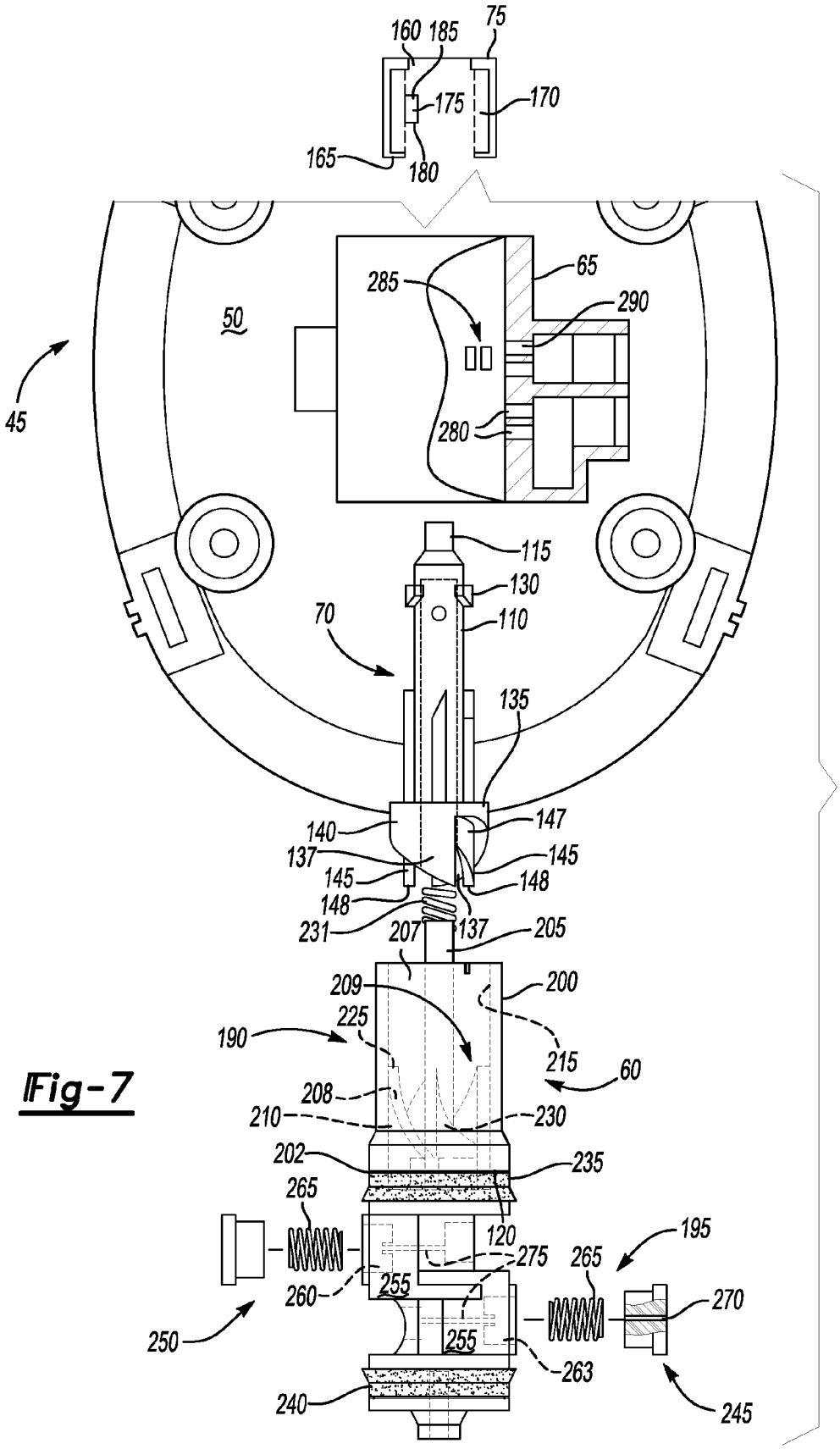
FIG. 7 is a perspective exploded view of a portion of the hand held of FIG. 1.

Referring now to FIGS. 2 and 7, a support plate 45 is shown which shows the back side of the support plate 45. Spray side 55 is on the opposite side and may be seen as spray face 30 in FIG. 1. A valve 60 disposed on a valve housing 65. A button stem 70 is disposed in the stem housing on the support plate 45.

The push button in valve 60 is disposed in valve housing 65 disposed on the support plate 45. The push button 15 has a U-shaped body 80 having legs 85 and a cover 90 that connects the legs. An internal cup 95 is disposed on the inside of the cover as will be discussed infra. The legs 85 have flanges 100 that help keep the button within the housing 20. The housing has shoulders 105 that interact with the flanges 100 to provide this feature. A protrusion 115 that is disposed in cup 95 provides a closing end 120 for the body 110. A spring 125 disposed in the cup between the protrusion 115 and the cover 90.

Four bosses 130, which have a rectangular shape and help create rotation of the valve 60 with the stem housing 75 as will be discussed infra, are disposed equally about the diameter of the body 110. A lower portion 135 of the body has an expanded radius relative to the protrusion 115. The lower portion 135 has two triangularly-shaped cam followers 137 and two internal triangularly-shaped cam surfaces 145 on an internal portion 147 of the lower portion 135. Each of the triangular surfaces has a semi circularly triangle shape with apices 148 disposed towards the valve 60. The apices 148 are distributed regularly around the circumference of the lower portion 135 and are offset at approximately a 90° angle.

The stem housing 75 has an axial top 160 and an axial bottom 165 and an internal circumferential surface 170. The surface 170 has a first set of cam surfaces 175 that have a triangular apex 180 and a bottom of the stem housing and a base 185 at the top of the stem housing. The four cam surfaces interact with the bosses 130 as will be discussed infra.

The valve 60 has two sections, the rotation section 190 and a control section 195. The rotation section 190 has a cylindrical housing 200 having the closed end 202, a post 205 and an open end 207. The second set of cam surfaces 209 interact with cam followers 140, and 145 within the button stem. Each of the cam surfaces within the button stem 70. The cam surfaces 208 extend axially towards the cam followers 137 and cam surfaces 145 in the lower portion 135. Each of the cam surfaces 208 have triangular bodies 210 on an inner side 215 of the cylindrical housing 200 and bend from the closed end 202 within the rotation section 190, and a base thereon 220, a cam surface 225 that interacts with cam follower 140 and cam surfaces 230 extend from the closed end 202 and interact with cam surfaces 145. As with the button stem 70, the cam surfaces 225, 230 are distributed around the inside of the rotation section 190 at approximately a 90° angle.

A spring 231 is disposed at an end of the post 205 within the body 110. A spring 231 is disposed between the post 205 of the valve rotation section and the hollow button stem body 110 so that upon actuation the button is returned so that the flanges 100 of the push bottom body 80 are disposed against the housing shoulders 105 that extend upwardly from the backside 50 of the support plate 45.

The cam surfaces and cam followers of the button stem 70 and the rotation section 190 in conjunction with the cam surfaces of the stem housing 75 and the bosses 130 of the button stem 70 interact if the button 15 is pressed to provide a rotational motion on the valve 60, like the motion of a retractable pen (not shown) such that a single click of the button 15 serves to rotate the control section 195 90° thereby providing at least four functions as the control section 195 allows flow and disallows flow in the through the valve 60 as will be discussed herein.

Control section 195 has two spaced seals, a top circular seal 235 and a bottom circular seal 240. Additionally, the control section valve 60 has two radially spaced seals, a bottom seal 245 and a top seal 250. The bottom seal 245 and the top seal 250 are spaced around the valve with a distance of 180° . The seals 245 and 250 are also offset axially. Each seal 245, 250 is placed in a housing 255 with seal 250 disposed in recess 260 and seal 245 disposed in recess 263. Each seal 240, 245 is pushed radially outwardly by a spring 265 that is disposed within the recesses 260, 263 to urge the seal members 245 and 250 into engagement with inlet and outlet holes in the valve housing 65 as will be discussed herein. The bottom seal 245 has a conduit 270 and the housing has a conduit 275 in registration with the conduit 270 as will be discussed infra.

Figure 2A:
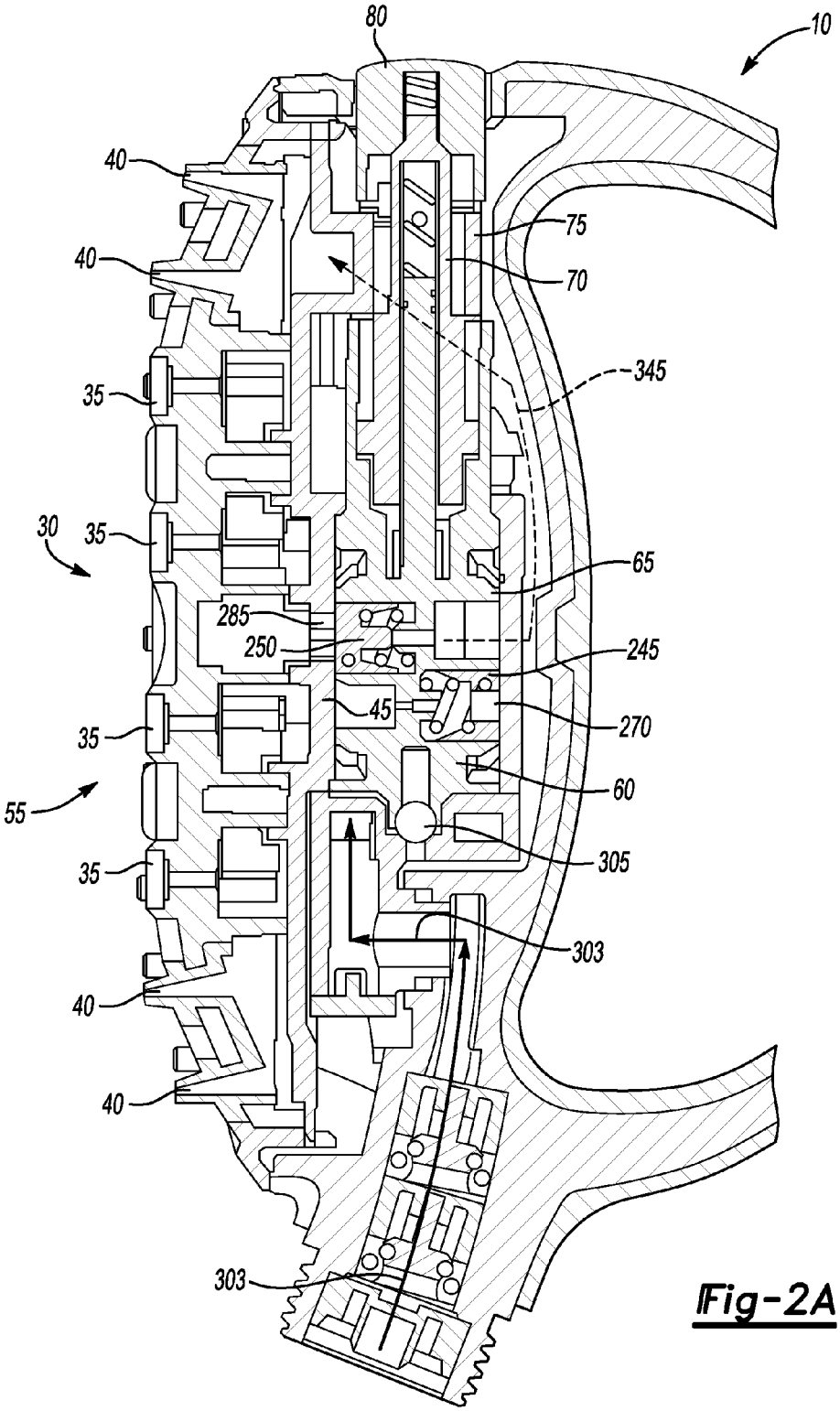
FIG. 2A is a side view of cutaway of FIG. 2.

Referring to FIGS. 2, 2A and 7, the valve housing 65 has a pair of first inlet holes 280 that connect to the inlet 27 via conduit 303. First outlet holes 285 provide a conduit to the spray nozzles 40 and second outlet holes 290 provide a conduit to the massage nozzles 35. A ball 305 is placed in the wall seat 310 to allow the valves 60 to rotate with a minimal amount of friction. The first inlet holes 280 are adjacent to the second outlet holes 290 axially. As such, the bottom seal 245 only restricts inlet of the water in one position of the valve and in the other three positions of the valve water is admitted to the center of the valve in which the top seal 250 allows flow to either the spray nozzles 40 through first outlet holes 285, the second outlet holes 290 to the massage nozzles 35, to both of the first outlet holes 285 to spray nozzles 40 and the second outlet holes 325 to massage nozzles 35 or to neither of those nozzles.

If the bottom seal 245 closes the first inlet holes 280, the opening 270 allows water through the seal 245 and through opening 275 to leak a small amount of water to both the spray nozzles 40 and the massage nozzles 35 because the seal 250 is not aligned with either the first outlet holes 285 or the second outlet holes 290.

Figure 3:
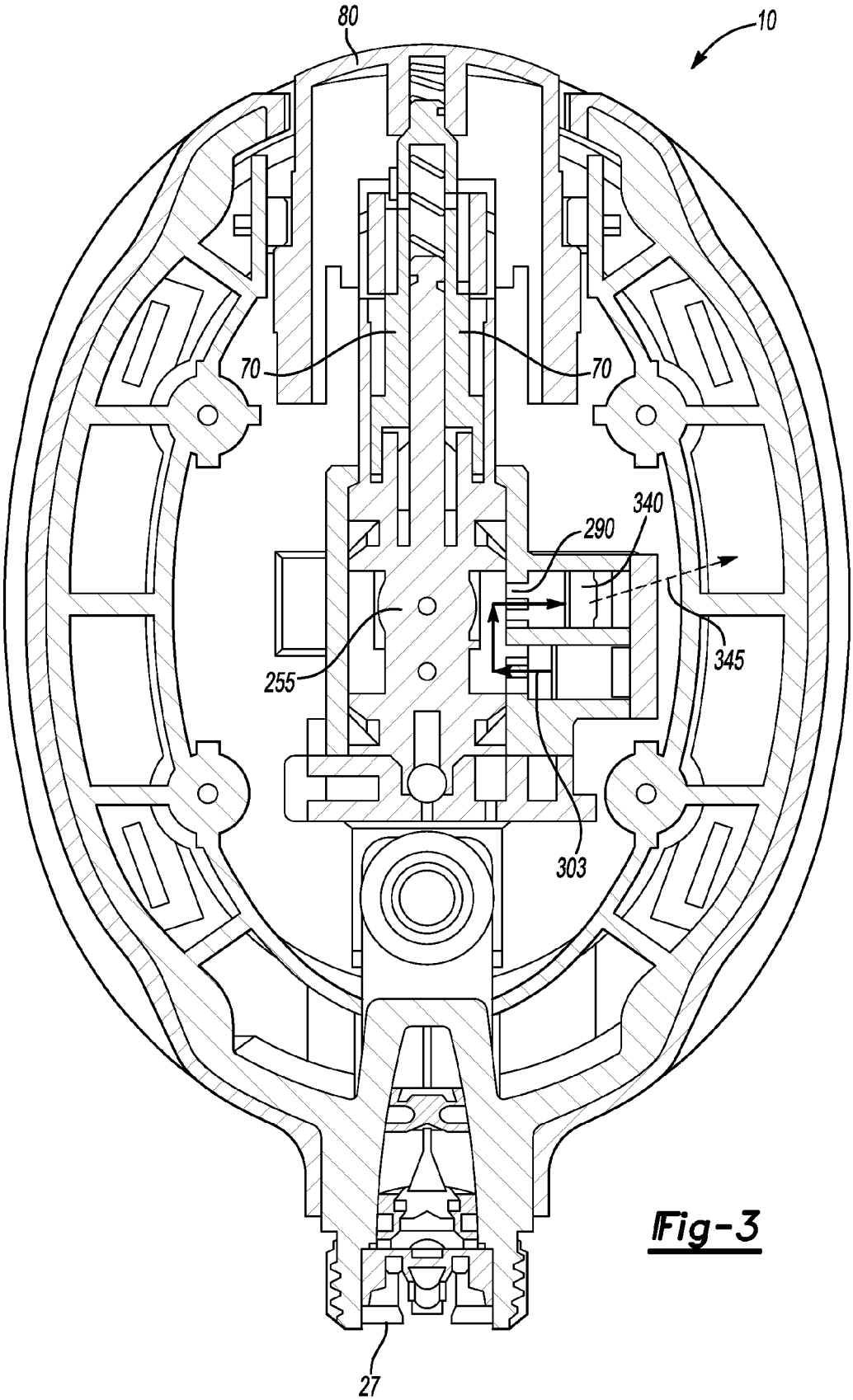
FIG. 3 is a top view, partially cutaway, of a first function of the hand held of FIG. 1 in which water directed to a spray.

Referring to FIGS. 2A and 3, top seal 250 is shown sealing first outlet holes 285 that allow flow to the massage nozzles 35. In this position, the bottom seal 245 does not seal water from passing through the first inlet holes 280 as it is offset from the first inlet holes 280 by 90°. Water is then free to pass through second outlet holes 290 into a channel 340 and through paths 345 that channels water to the spray nozzles 40. This first function allows a user to use the shower head as a spray only.

Figure 4:
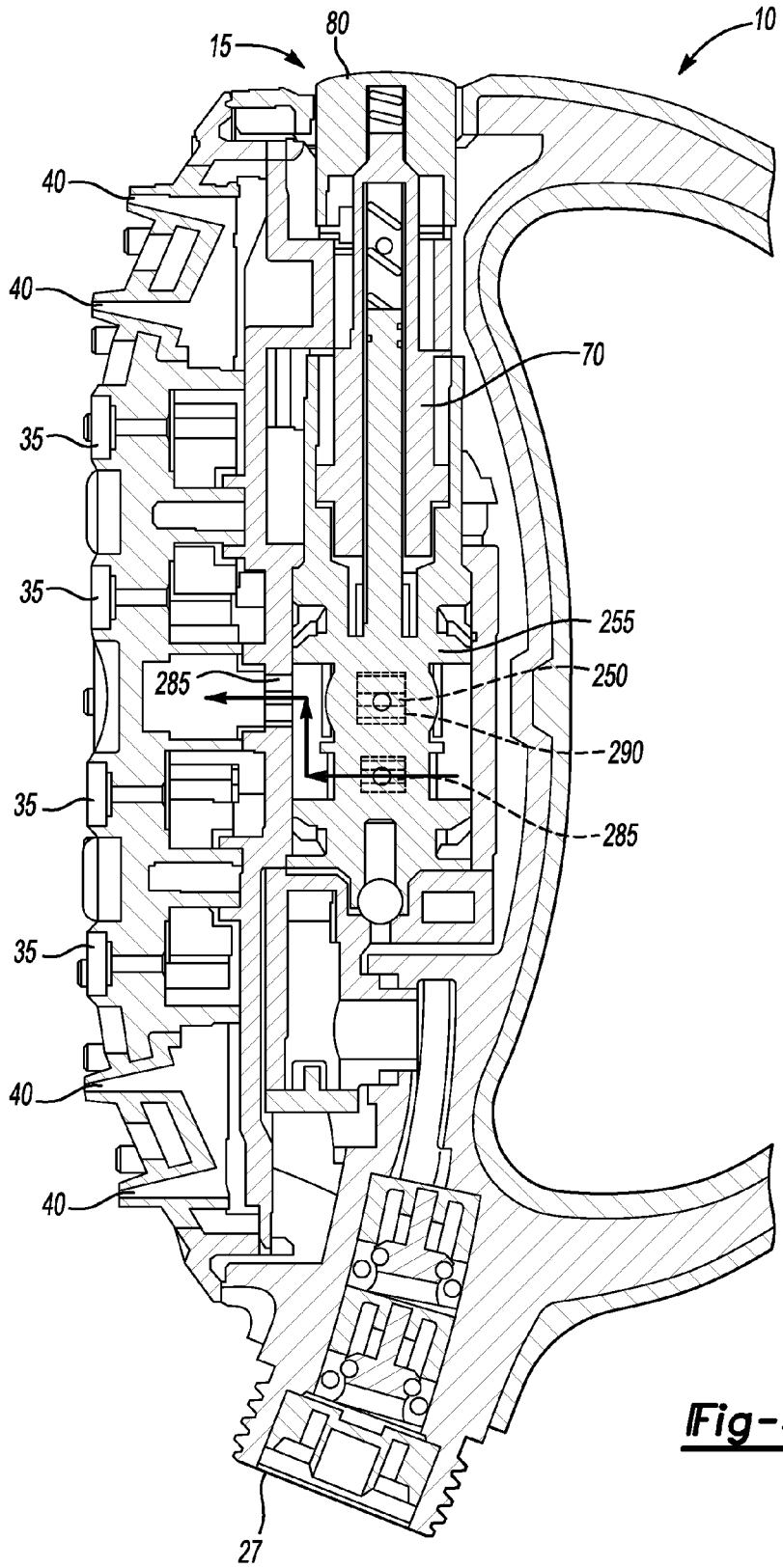
FIG. 4 is a side view, partially cutaway, of a second function of the hand held of FIG. 1 in which water directed to a spray.

Referring to FIG. 4, the push button 15 is pushed to rotate the valve 60 90° so that the top seal 250 does not seal the first outlet holes 285 that allow flow to the massage nozzles 35 but does seal the second outlet holes 290 to prevent flow to the spray nozzles 40. In this position, the bottom seal 245 does not seal water from passing through the first inlet holes 280 as it is offset from the first inlet holes 280 by 90°. Water is then free to pass through first outlet holes 285 to channel water to the massage nozzles 35 and not the spray nozzles 40. This second function allows a user to use the shower head as a massage only.

Figure 5:
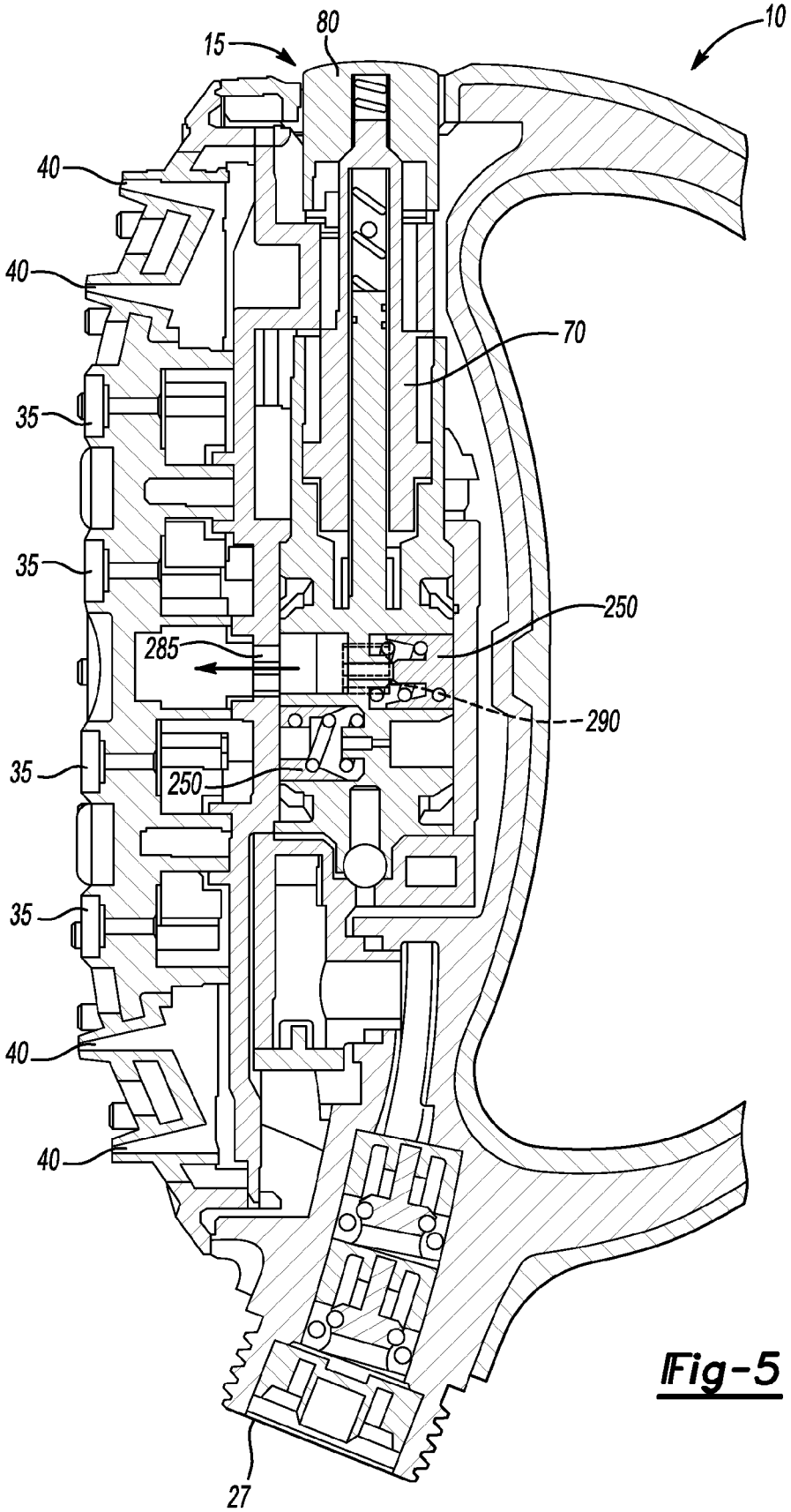
FIG. 5 is a side view, partially cutaway, of a third function of the hand held of FIG. 1 in which water is directed to a spray and a massage.
Figure 5A:
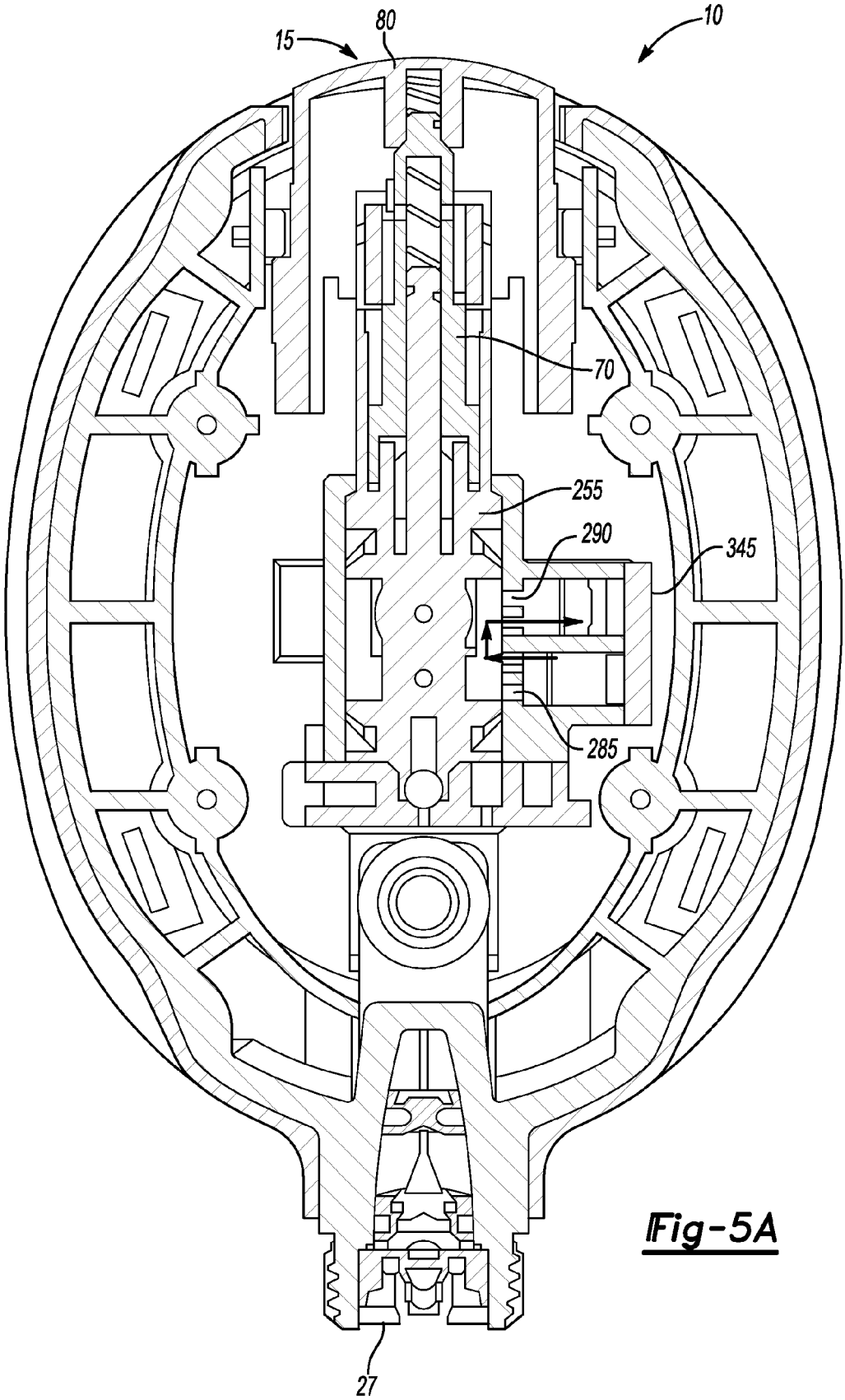
FIG. 5A is a top view of the hand held of FIG. 5.

Referring to FIGS. 5 and 5A, the push button 15 is pushed again to rotate the valve 60 90° so that the top seal 250 does not seal the first outlet holes 285 that allow flow to the massage nozzles 35 and does not seal the second outlet holes 290 to allow flow to the spray nozzles 40. In this position, the bottom seal 245 does not seal water from passing through the first inlet holes 280 as it is offset from the first inlet holes 280 by 180° from its initial position. Water is then free to pass through first outlet holes 285 to channel water to the spray nozzles 40 and to the massage nozzles 35 via second outlet holes 290 and paths 345. This third function allows a user to use the shower head as a spray and a massage.

Figure 6:
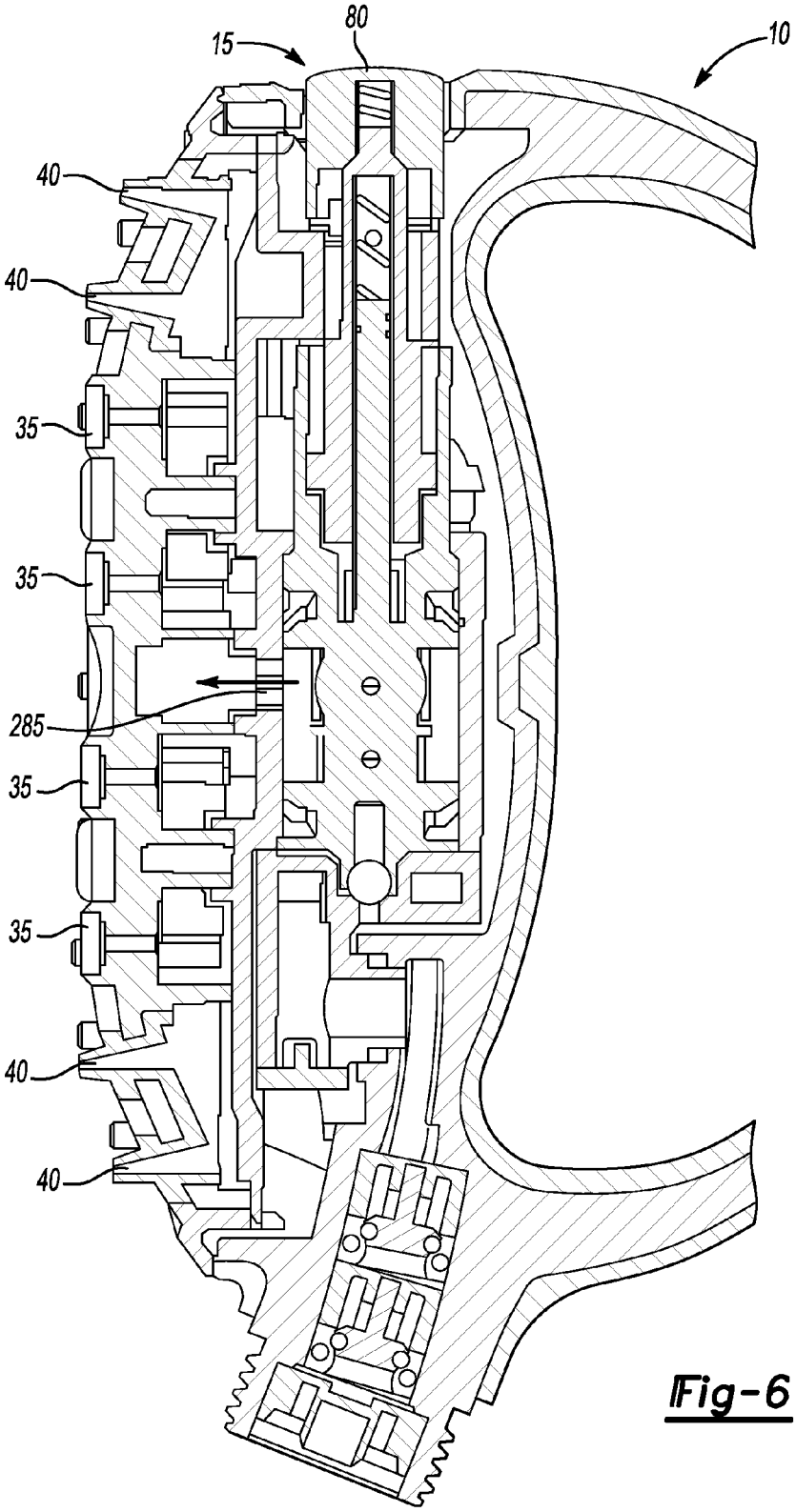
FIG. 6 is a side view, partially cutaway, of a fourth function of the hand held of FIG. 1 in which water is not directed to a spray or a massage.
Figure 6A:
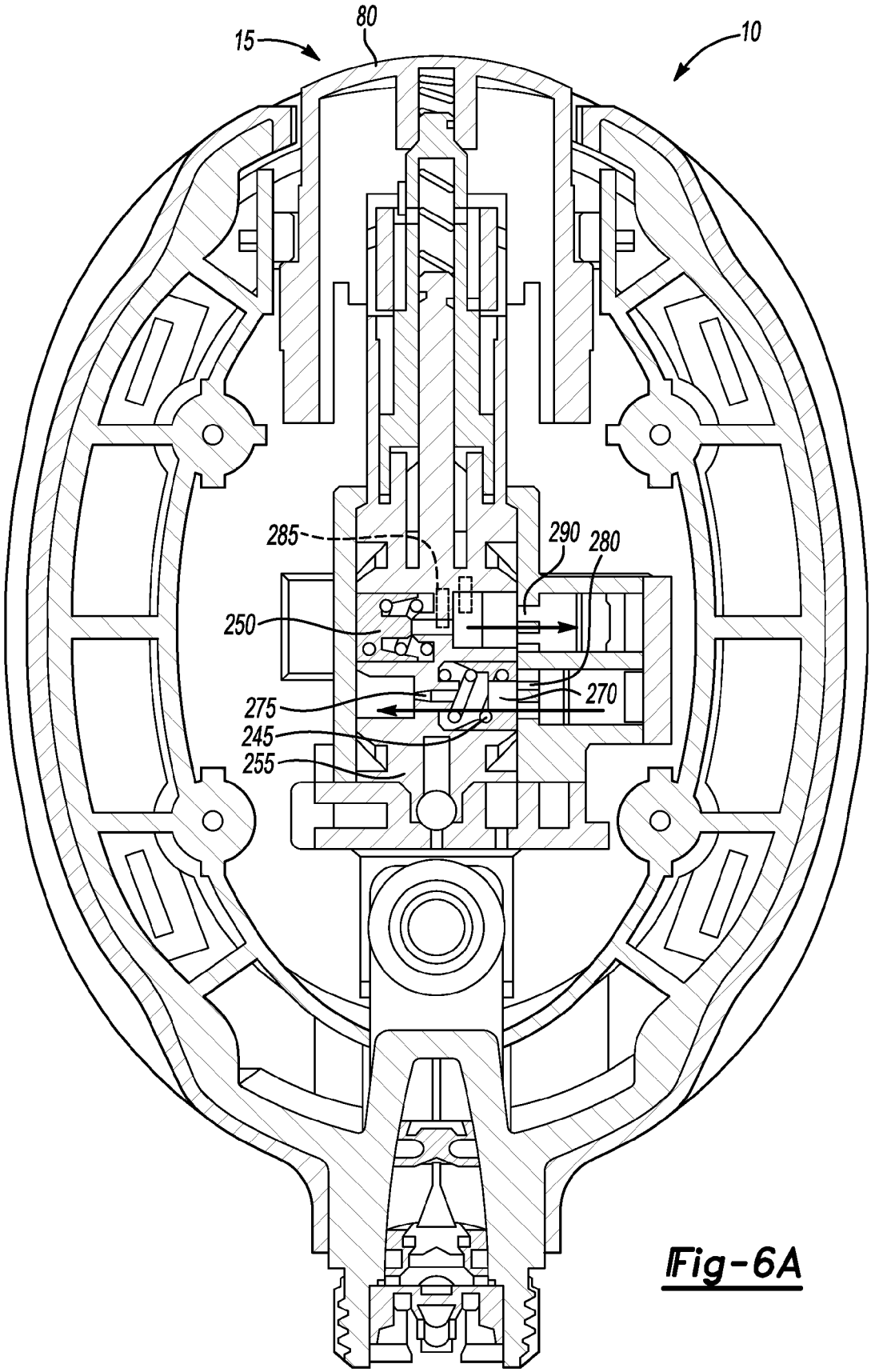
FIG. 6A is a top view of hand held of FIG. 6.

Referring to FIGS. 6 and 6A, the push button 15 is pushed again to rotate the valve 60 90° so that the top seal 250 does not seal the first outlet holes 285 that allow flow to the massage nozzles 35 and does not seal the second outlet holes 290 to allow flow to the spray nozzles 40. In this position, the bottom seal 245 does seal water from passing through the first inlet holes 280 as it is offset from the first inlet holes 280 by 270° from its initial position. Water then passes relatively slowly through the narrow conduit 270 in the bottom seal 245 and conduit 275 in the housing 255 to first outlet holes 285 to channel water to the spray nozzles 40 and to the massage nozzles 35 via second outlet holes 290 and paths 345. This fourth function is a water saving feature that allows a user to pause using the hand held 10 while allowing some water to trickle through the shower head.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from the essence of this disclosure. The scope of legal protection given to this disclosure can only be determined by studying the following claims.

What is claimed is:

1. A shower head comprising:

a push-button operated rotatable valve, disposed about an axis, having a plurality of positions including a first position in which said rotatable valve allows water to flow to a first function, a second position circumferentially offset from said first position in which said rotatable valve allows water to flow to a second function, a third position circumferentially offset from said first position and said second position in which said rotatable valve allows water to trickle through said shower head, a housing in which said valve is placed, said housing having a first outlet in fluid communication with said first function and a second outlet in fluid communication with said second function, said first and second outlets being radially offset from each other about an axis, an inlet axially offset from said first and second outlets along said axis, and a first seal member that engages said first and second outlets and a second seal member that engages said inlet, wherein said first and second seal members are axially and radially offset from each other.

2. The shower head of claim 1 further comprising:

a fourth position circumferentially offset from said first position, said second position, and said third position, in which water flows to said first function and said second function.

3. The shower head of claim 2 wherein said first function is a spray and said second function is a massage.

4. The shower head of claim 1 wherein said first function is a spray.

5. The shower head of claim 1 wherein said second function is a massage.

6. The shower head of claim 1 wherein said first seal and said second seal are offset from each other 180°.

7. The shower head of claim 6 wherein said first and second outlets are offset from each other by 90°.

8. The shower head of claim 1 wherein said first and second outlets are offset from each other by 90°.

9. The shower head of claim 1, wherein the rotatable valve rotates circumferentially 90° from said first position to said second position and from said second position to said third position.

10. The shower head of claim 1, wherein said rotatable valve includes a rotation section and a control section, said rotation section including a cylindrical housing, said control section including a plurality of seals.

11. The shower head of claim 10, wherein said plurality of seals includes at least one seal defining a conduit to allow flow when the rotatable seal is in the third position.

12. The shower head of claim 1, wherein said rotatable valve rotates 90° in response to the push button being pushed.

13. The shower head of claim 1, wherein said first outlet and said second outlet are disposed on a face of the shower head.

14. The shower head of claim 13, wherein each of said first outlet and said second outlet are in fluid communication with a fluid path.

15. A shower head comprising:

a housing having;

a first outlet in fluid communication with a first function, a second outlet in fluid communication with said second function, said first and second outlets being radially offset from each other about an axis, an inlet axially offset from said first and second outlets, and a valve disposed within said housing and rotatable into a plurality of positions by a push button mechanism, said valve having;

a first seal member that engages said first and second outlets and a second seal member that engages said inlet, wherein said first and second seal members are axially and radially offset from each other.

16. The shower head of claim 15 wherein said second seal has a conduit passing therethrough.

17. The shower head of claim 15 wherein said plurality of positions further comprises a first position in which said second seal does not block said inlet and said first seal engages said first outlet.

18. The shower head of claim 15 wherein said plurality of positions further comprises:

a second position in which said second seal does not block said inlet and said first seal engages said second outlet.

19. The shower head of claim 15 wherein said plurality of positions further comprises:

a third position in which said second seal does not block said inlet and said first seal does not engage either of said first outlet or said second outlet.

20. The shower head of claim 19, wherein said first seal does not engage an outlet.

21. The shower head of claim 15 wherein said plurality of positions further comprises:

a fourth position in which said second seal blocks said inlet and said first seal does not engage either of said first outlet or said second outlet.

22. The shower head of claim 15 wherein said second seal has a conduit passing therethrough such that water may trickle therethrough when said valve is in said fourth position.

23. The shower head of claim 15 wherein said first and second outlets are offset from each other by 90°.

* * * * *